US008763185B2

(12) United States Patent
Deschamps

(10) Patent No.: US 8,763,185 B2
(45) Date of Patent: Jul. 1, 2014

(54) TEMPORARY BRIDGE

(75) Inventor: Georges-Paul Deschamps, Voeuil et Giget (FR)

(73) Assignee: Ets A. Deschamps et Fils, La Couronne (FR)

( * ) Notice: Subject to any disclaimer, the term of this patent is extended or adjusted under 35 U.S.C. 154(b) by 0 days.

(21) Appl. No.: 13/319,143

(22) PCT Filed: Mar. 15, 2010

(86) PCT No.: PCT/EP2010/053319
§ 371 (c)(1),
(2), (4) Date: Dec. 14, 2011

(87) PCT Pub. No.: WO2010/127894
PCT Pub. Date: Nov. 11, 2010

(65) Prior Publication Data

US 2012/0074035 A1 Mar. 29, 2012

(30) Foreign Application Priority Data

May 6, 2009 (FR) ..... 09 53010

(51) Int. Cl.
*E01D 15/12* (2006.01)

(52) U.S. Cl.
USPC ..... 14/2.4

(58) Field of Classification Search
USPC ..... 14/2.4, 2.5, 2.6, 45; 414/137.1
See application file for complete search history.

(56) References Cited

U.S. PATENT DOCUMENTS

| | | | | | |
|---|---|---|---|---|---|
| 175,150 | A | * | 3/1876 | Pfautz | 14/45 |
| 925,922 | A | * | 6/1909 | Knapke et al. | 182/62.5 |
| 960,022 | A | * | 5/1910 | Kelemen et al. | 14/45 |
| 3,134,116 | A | * | 5/1964 | Adkins et al. | 14/2.6 |
| 4,527,941 | A | * | 7/1985 | Archer | 414/537 |
| 4,571,144 | A | * | 2/1986 | Guidry et al. | 414/537 |

(Continued)

FOREIGN PATENT DOCUMENTS

| | | |
|---|---|---|
| EP | 1 584 748 | 10/2005 |
| GB | 2250046 | 5/1992 |
| WO | 95/26435 | 10/1995 |
| WO | 2007/138100 | 12/2007 |

OTHER PUBLICATIONS

International Search Report dated Aug. 2, 2010, corresponding to PCT/EP2010/053319.

*Primary Examiner* — Matthew D Troutman
(74) *Attorney, Agent, or Firm* — Young & Thompson

(57) ABSTRACT

A temporary bridge includes two spans, each including at least three bridge elements to be stacked when the bridge is in a first so-called non-deployed position. The bridge elements are pivotably connected to one another, wherein two consecutive bridge elements are connected to one another by at least two linking arms mounted on the same side edge of the bridge elements. Two consecutive linking arms form a regular parallelogram with the two consecutive bridge elements connected by the arms, which can be deformed such that the movement of one bridge element relative to a bridge element immediately below in the stack of a span in the non-deployed position of the bridge causes the circular translation of the bridge element relative to the bridge element of the span immediately below. For at least one of the spans, at least one of the linking arms is shared by three consecutive bridge elements.

20 Claims, 9 Drawing Sheets

(56) References Cited

U.S. PATENT DOCUMENTS

| | | | | | |
|---|---|---|---|---|---|
| 4,635,311 | A * | 1/1987 | Helmke | 14/2.5 |
| 4,972,538 | A * | 11/1990 | Parramore | 14/2.5 |
| 5,039,119 | A * | 8/1991 | Baughman | 280/166 |
| 5,173,981 | A * | 12/1992 | Hasselkvist | 14/2.4 |
| 5,216,773 | A * | 6/1993 | Haakonsen | 14/2.6 |
| 5,547,040 | A * | 8/1996 | Hanser et al. | 182/88 |
| 5,941,342 | A * | 8/1999 | Lee | 182/95 |
| 2010/0031454 | A1 * | 2/2010 | Deschamps | 14/2.4 |

* cited by examiner

TEMPORARY BRIDGE

BACKGROUND OF THE INVENTION

1. Field of the Invention

The present invention relates to a temporary bridge intended for crossing gaps, particularly for the passage of pedestrians, vehicles, or other mobile equipment.

2. Description of the Related Art

Such bridges that can be used for crossing gaps using one or more joists joined together, these joists being possibly foldable when these bridges are in the rest position, are known.

However, it is necessary to use a bridge-laying vehicle to transport and deploy these joists. The system for deploying these joists is therefore particularly complicated in order to take into account both the large dimensions of these joists and also the working area offered by the chassis of the bridge-laying vehicle. This system notably requires a launch ramp that allows the assembled joists to be set down toward the front of the vehicle.

In addition, the dimensions of the joists typically mean that the terrain has to be clear in order to allow these joists to be deployed.

It may therefore prove necessary prior to deployment of the bridge for the terrain to be prepared by qualified operatives, notably, by way of example, when there are wooded areas adjacent to the gap that is to be crossed.

Moreover, the trackway of these joists has to be capable, in certain applications, of taking one or more heavy vehicles. This trackway is therefore rigid and secured to each of the joists. It may, for example, be made of steel, wood or composite. The trackway thus increases the total weight of the bridge that has to be transported.

In addition, when the joists are of greater dimensions than the launch ramp, the weight of the joists thus assembled has to be counterbalanced by the weight of the bridge-laying vehicle in order to avoid any potential imbalance of this vehicle when laying the bridge. The vehicle, which has therefore to have a suitable chassis, has difficulty in moving over uneven ground.

Finally, these crossing systems of the prior art are not autonomous and require the presence of service personnel who are then particularly exposed and vulnerable in conflict zones for example.

BRIEF SUMMARY OF THE INVENTION

It would therefore be advantageous to have an autonomous, compact crossing structure that could be deployed remotely.

It is an objective of the present invention to propose a gap crossing system that is simple in its design and in its operation, that is particularly compact and lightweight to allow deployment in zones that are difficult to access and under all types of operational conditions.

The present invention therefore relates to a particularly lightweight temporary bridge allowing the use of a carrier vehicle that is not as heavy, and is therefore more mobile and able to move around in regions of uneven ground inaccessible to bridge-laying vehicles of the prior art. This objective is achieved through a drastic reduction in the number of actuators needed to deploy the bridge, this reduction being permitted by the use of linking arms that simultaneously connect three consecutive bridge elements together.

This lightening of the temporary bridge can be further accentuated by the use of a lightweight trackway. This trackway is then added on after the temporary bridge has been deployed, for example. Deploying the bridge without its trackway additionally allows the use of a deployment system that is less complicated and quicker.

Another subject of the present invention is a container/temporary bridge assembly that is completely autonomous and allows the temporary bridge to be deployed from said container.

This container is, moreover, compact in order not to entail the of a special-purpose carrier vehicle but rather a transporter truck equipped with a handling arm. This container is also shippable as it can be loaded/off-loaded using conventional infrastructures.

To this end, the invention relates to a temporary bridge comprising two spans each comprising at least three bridge elements intended to be superposed when the bridge is in a first position known as the non-deployed position, the bridge elements of each of said spans being articulated to one another, two consecutive bridge elements being joined together by at least two linking arms mounted on one and the same lateral edge of said bridge elements.

According to the invention,

- two consecutive linking arms form, with the two consecutive bridge elements that they connect, a deformable regular parallelogram so that the movement of one bridge element with respect to a bridge element immediately below it in the stack of one span from said non-deployed position of said bridge causes a circular translational movement of said bridge element with respect to said bridge element immediately below it in said span,
- for at least one of said spans, at least one of said linking arms is common to three consecutive bridge elements, said three consecutive bridge elements being connected to one another by said same linking arm,
- said bridge comprises means of moving each of the bridge elements which is superposed on another bridge element in said first position, between this first position and a second position known as the deployed position, in which said bridge elements are coupled together to form said bridge.

The linking arms each connecting three consecutive bridge elements advantageously ensure that the bridge elements thus connected move simultaneously and uniformly.

"Consecutive bridge elements" means that these bridge elements of one same span are positioned directly one above the next in the stack when the temporary bridge is in the position known as the non-deployed position. These consecutive, or successive, bridge elements of one and the same span are intended to be placed end to end to form at least part of the deployed bridge.

Because the bridge elements are joined together by at least two linking arms, moving one bridge element with respect to a bridge element immediately below it in the stack of one span causes a circular translational movement of said upper bridge element. To allow this movement, the ends of the arms are mounted with the ability to rotate on the bridge elements.

"Trackway" here means the external surface of the temporary bridge on which the pedestrians, vehicles and other mobile equipment are intended to travel. Of course, although they do not have a practicable trackway when the trackway has yet to be added on, these elements are structurally capable of supporting these vehicles and/or pedestrians. Such bridge elements are then, purely by way of illustration, made up of a latticework structure or of an assembly of parallel girders, these girders being spaced apart either evenly or otherwise.

Of course, the movement means for moving each of the bridge elements may be distinct from the temporary bridge. They may, for example, be placed on the container used for transporting this temporary bridge in its first position known as its non-deployed position. Purely by way of illustration, these movement means are positioned on the floor structure of this container.

In various particular embodiments of this temporary bridge, each of which has its own particular advantages and which can be combined in numerous technically feasible ways:

at least one bridge element of one of said spans is connected to a corresponding bridge element of the other span.

Thus, these bridge elements move in unison.

For preference, the bridge comprises one or more reinforcing elements connecting the two spans together. Purely by way of illustration, these reinforcing elements are transverse girders, or spacer pieces, connecting the two spans together at the corresponding bridge elements.

"Corresponding bridge elements of the two spans" means that these elements are positioned in the same order and position in each of the two spans.

Purely by way of illustration, the bridge element of a first span that corresponds to the distal end bridge element of the other span, i.e. the bridge element placed at the top end of the stack of bridge elements of this other span when the bridge is in the non-deployed position, is the distal end bridge element of the first span.

with said linking arms being common to the two spans, a portion of a linking arm connected in rotation to a bridge element of a first span is also connected in rotation to a corresponding bridge element of the other span, said linking arms are mounted on one and the same lateral edge of said bridge elements between the two spans, for each span, with the bridge element intended to constitute the bottom end of the stack formed by the superposed bridge elements when the temporary bridge is in said first position being received on a support, the movement means for moving each of the bridge elements comprise an actuator connected pivotingly to said support.

Alternatively, this actuator may be connected pivotingly to the floor structure of the container.

The moving other end of this actuator is, for example, connected to one of said linking arms of at least one of said spans or to a reinforcing element connecting said spans.

with each one of said spans comprising n bridge elements with $n \geq 3$, the number of linking arms connecting each three consecutive bridge elements together is equal to n-2, said movement means for moving each of said bridge elements comprise a single actuator the moving end of which is connected removably or non-removably to the two spans so as to move the bridge elements of the two spans simultaneously.

For preference, the moving end of said actuator is then connected removably or non-removably to a reinforcing element connecting the two spans together.

with the moving end of said actuator being connected to a linking arm of each of said spans, each of said linking arms to which said moving end is connected comprises a link rod connecting three consecutive bridge elements together and an element for driving said link rod to which the free end of said actuator is connected, said link rod being connected to said drive element by a flexible connection so that said actuator is able to move the assembly comprising said link rod and said drive element from a rest position into a position of separation of said link rod in which position said link rod separates from said drive element to continue its movement while at the same time remaining connected to said drive element by said flexible connection.

This free end of the actuator may either be connected directly to the linking arms via a rotary attachment or to a reinforcing element connecting the spans together.

said drive element or elements each comprise a winding-unwinding device to accept said flexible connection, the bridge element that is intended to constitute the bottom end of the stack formed by said superposed bridge elements comprises means of anchoring to the ground, each bridge element comprises, at least at one of its ends, a coupling face that is able to collaborate with the coupling face of another bridge element so as to assemble these bridge elements when they are positioned end to end.

These coupling faces may have a beveled or any other shaped profile that allows the coupling faces of two consecutive bridge elements to be locked in position when placed end to end.

These faces may moreover be sloped by an amount that is the same from one pair of consecutive bridge elements thus assembled to another, but these slopes could also differ so as to give said temporary bridge a degree of curvature. This curvature may notably be progressive in order to form an arch. The latter geometry not only gives the temporary bridge better mechanical integrity by reacting load but also makes it possible to straddle obstacles such as a pipeline or the like.

for each span, the bridge element intended to constitute the bottom end of the stack formed by the superposed bridge elements when the temporary bridge is in the non-deployed position comprises at least one jack for raising or lowering the temporary bridge in its deployed position with respect to the surface of the ground surrounding each of said bridge elements.

These jacks are advantageously able to pivot between a rest position in which they are positioned along their corresponding bridge element so as to allow the temporary bridge in the non-deployed position to be positioned in a container, and an active position in which they are directed toward the ground so that their free end can come into contact with the ground to allow the temporary bridge to be raised or lowered in the deployed position.

Purely by way of illustration, with the bridge in its deployed position, this bridge rests on two jacks each placed at one corner of said temporary bridge in its deployed position.

These jacks have numerous advantages. First, they can be used to raise the temporary bridge above the end of the axis of pivoting in the bottom of the container in order to detach the temporary bridge from the container.

These jacks can also make it possible to compensate for a difference in relative height between the sides of the gap that is to be crossed, it being possible for this difference in height to be a positive or a negative one. Thus, if the side opposite the side of the gap from which the temporary bridge is deployed is at an elevation, or height, that is lower than the latter, the jacks mounted on the distal bridge elements of the temporary bridge may make it possible to compensate for this difference in height and allow the bridge to be set down on the opposite side.

Alternatively, these jacks can be replaced by telescopic support members.

with the temporary bridge comprising a trackway added on to each of the two spans, said trackway is a flexible trackway and said spans comprise fastening elements for securing this flexible trackway to said bridge elements.

Alternatively, said added-on trackway may comprise metal plates articulated to one another.

the trackway comprises several trackway sections, each of these sections being secured to one bridge element, the trackway is one piece and removable, the flexible trackway comprises at least one woven structure.

This trackway may also comprise an auxiliary woven structure comprising a layer of warp threads and a layer of weft threads, said woven structure being superposed on said auxiliary woven structure and the two woven structures being interwoven in such a way as to form, between the two structures, and from place to place, tubular pockets directed along the warp threads or along the weft threads.

In particular, when these pockets are directed in the lengthways direction of the bridge, they may act as housings to accept elements that have been added on for various purposes. In particular, it is possible to run one or more power cables for supplying electrical power to the means that perform the relative movement of the bridge elements. It is also possible to run communications cables or power cables for lighting the temporary bridge.

These pockets may also accept metal or composite reinforcing bars. When these pockets are fitted with transverse reinforcing bars, the ends of these bars may form projections intended to collaborate with guide rail elements laid along the bridge elements. The ends of these bars may thus slide in C-section or U-section rails, this not only guiding the trackway along said bridge element but also securing it thereto.

More generally, the trackway may comprise an upper face which has the surface relief necessary to ensure good grip for the vehicles running along its surface, such as the woven structure described by the present applicant in patent application WO 95/26435 and a flat underside to ensure that the trackway will slide over the bridge elements. This underside may be formed by said auxiliary woven structure.

This underside may also comprise fastening elements needed for securing said trackway to the bridge elements. In one particular embodiment, this underside may have eyelets intended to accept projections positioned on the surface of the bridge elements. These projections may be studs with an end-stop at their top end, the studs then being forcibly driven into the eyelets.

These eyelets are preferably positioned in line with pockets formed by the link between the auxiliary structure and the woven structure in order to form housings capable of accepting said projections.

Each bridge element on at least one of its lateral edges comprises a guide rail element, these rail elements collaborating with one another to define a guide rail when the bridge elements are placed end to end so as to guide the movement of said trackway along said bridge, the linking arm connecting said three bridge elements is at least the one that connects the bridge element intended to constitute the bottom end of the stack formed by said superposed bridge elements in said first position and said two bridge elements positioned just above it in said stack, this actuator is a hydraulic, electromagnetic or electric jack.

The linking arms may also be turned by motors or by a crank using a nutless or endless screw system.

the temporary bridge comprises at least one buoyant structure on which said temporary bridge is intended to be placed when said bridge is launched onto water, these bridge elements are joists, or bridge sections.

These bridge elements may be fixed in terms of width or have an adjustable width. Specifically, it may be advantageous to keep these bridge elements to small dimensions so that they can be stored and transported, while having a large trackway width. To do that, each bridge element may comprise an assembly of girders comprising a fixed central girder connected to lateral girders by a system for adjusting the spacing between the central girder and these lateral girders. Purely by way of illustration, this adjusting system may comprise jacks connected at their ends to said girders and positioned therebetween. These jacks are, for example, hydraulic jacks.

Of course, when the trackway is made up of several trackway sections each of which is secured to one bridge element, each of these trackway sections comprises at least two at least partially superposed parts capable of sliding one relative to the other in order to adapt to suit the variations in width of the bridge element.

Each of these parts is, for example, secured to a lateral girder. The movement of this lateral girder with respect to the central girder causes a corresponding sliding of the trackway section part.

Alternatively, at least some of the bridge elements of each of these spans comprise fastening means capable of retaining a lateral extension of the trackway. Purely by way of illustration, this lateral extension may comprise a single plate or several plates joined together.

The invention also relates to a temporary bridge with several trackways. According to the invention, this bridge comprises at least one central span positioned between two end spans, each of said spans comprising at least three bridge elements which are intended to be superposed when said bridge is in a first position known as the non-deployed position, said bridge elements of each of said spans being articulated to one another, two consecutive bridge elements being joined together by at least two linking arms which are mounted on one and the same lateral edge of said bridge elements between two spans, two consecutive linking arms form, with the two consecutive bridge elements that they connect, a deformable regular parallelogram so that the movement of one bridge element with respect to a bridge element immediately below it in the stack of one span from said non-deployed position of said bridge causes a circular translational movement of said bridge element with respect to said bridge element immediately below it in said span, for at least one of said spans, at least one of said linking arms is common to three consecutive bridge elements, said three consecutive bridge elements being connected to one another by said same linking arm, this bridge comprises means of moving each of said bridge elements which is superposed on another bridge element in said first position, between this first position and a second position known as the deployed position, in which said bridge elements are coupled together to form said bridge, said movement means comprising two actuators, each of these actuators being positioned at least partially between a distinct end span and said central span, the end of each of said actuators being connected to one of said linking arms of at least one of said corresponding spans or to a reinforcing element connecting the corresponding end span and the central span.

This end of each of said actuators can be connected removably or non-removably to one of said linking arms of at least one of said corresponding spans or to a reinforcing element that connects the corresponding end span and the central span.

Of course, these movement means may be distinct from the temporary bridge and positioned in the container used for transporting this temporary bridge, for example on the floor structure thereof.

The invention finally relates to an assembly comprising a temporary bridge and a container to hold said bridge in the position known as the non-deployed position. According to the invention, this bridge is a temporary bridge as described hereinabove.

This container, which may be a shipping container or a crate, is intended to be carried by a carrier vehicle. This carrier vehicle is advantageously an all-terrain vehicle such as a tracked vehicle or a wheeled vehicle.

When this container is a shipping container, said container preferably is a storage container measuring 20 feet (6.058 m) or 40 feet (12.192 m) long.

This assembly advantageously comprises a standalone power supply system for supplying power to said temporary bridge, this system comprising at least one hydraulic fluid storage unit, one hydraulic pump and a hydraulic feed circuit. This hydraulic circuit is connected to the temporary bridge actuator.

For preference, the bottom of said container comprises an axis of pivoting of said temporary bridge in its non-deployed position so as to allow said bridge to be rotated with respect to the bottom of the container in order to place the temporary bridge in a deployment position.

This deployment position corresponds at least to a positioning of the temporary bridge in its non-deployed position facing the wet or dry gap that is to be crossed. For preference, in this deployment position, the temporary bridge is also centered with respect to the container.

In one embodiment, this deployment position advantageously corresponds to a temporary bridge in its non-deployed position, oriented with a view to its being deployed in a direction that is the opposite to the direction of forward travel of the carrier vehicle supporting the container so that the carrier vehicle can back up to bring the temporary bridge as close as possible to the edge of the gap that is to be crossed.

The container may comprise a supporting turntable, this turntable being turned by a rotary tooth-rack jack, said turntable being able to accept the temporary bridge in its non-deployed position. For preference, this rotary jack is a hydraulic rotary tooth-rack jack.

The supporting turntable allows the movement of rotating the temporary bridge in its non-deployed position to bring it into its deployment position to be separated from the translational movement performed by the container when it is set down on the ground in order to launch the temporary bridge.

This turntable also allows the temporary bridge to be lashed down in its transport and deployment positions so that the rolling runners connected to the turntable work only in the rotational phase, as the loadings during transport and especially during deployment are too great for these rolling runners to bear.

This container may further comprise an area for storing the trackway and means for unwinding/winding up this trackway when this trackway is a flexible one.

For preference, the container comprises a floor structure comprising a housing that at least partially accepts said movement means that move each of said bridge elements in a rest position so that said means can move aside at least in part in this position to allow said temporary bridge in its non-deployed position to be positioned in said container in its transport position.

BRIEF DESCRIPTION OF THE DRAWINGS

The invention will be described in greater detail with reference to the attached drawings in which.

DETAILED DESCRIPTION OF THE INVENTION

Figure 1:
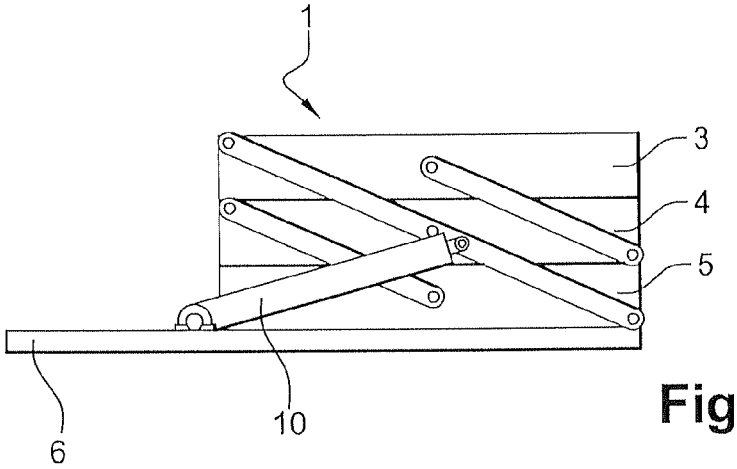
FIG. 1 schematically depicts a partial view of a temporary bridge in its position known as the non-deployed position according to one particular embodiment of the invention, and for the sake of clarity, one of the two spans of the bridge has been omitted.
Figure 2:
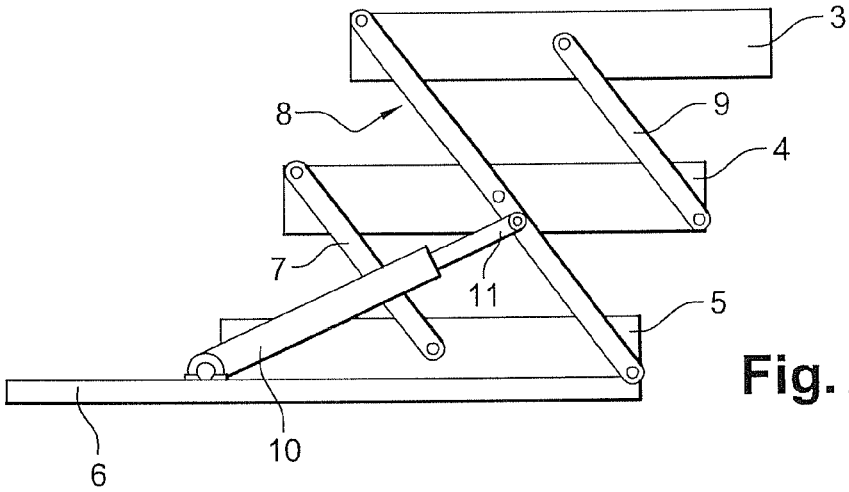
FIG. 2 is a schematic depiction of the temporary bridge of FIG. 1 at the start of its deployment phase.

FIGS. 1 to 5 are successive and partial views of the deployment of a temporary bridge according to one particular embodiment of the invention. The key stages in the deployment of this temporary bridge are thus depicted, from its initial position known as the non-deployed position to its final position in which the bridge is fully deployed to allow vehicles and/or people to cross over a gap.

This improved temporary bridge comprises two spans 1, 2 each comprising three bridge elements 3-5 which are superposed in a first position, known as the non-deployed position, of the bridge to form a vertical stack. These two stacks, which correspond to the two spans, occupy a very small volume which means that this temporary bridge can be transported in a shipping container. The dimensions of the container advantageously allow it to be transported by road, or even by river.

This temporary bridge comprises a platform or bed 6 to which, for each span 1, 2, the bridge elements 3-5 intended to form the lower end of the stack when the bridge is in the non-deployed position are fastened. This platform 6 advantageously can be used to support, move and orient this temporary bridge in its non-deployed position.

This platform 6 may comprise means of anchorage to the ground (which have not been depicted) giving the bridge a firm footing on loose or unstable ground. These anchor means may comprise reliefs placed on the underside of the platform 6 or even piles connected in an articulated fashion to the top surface of the platform so that they can pivot between a storage position in which these piles are positioned on top of the platform 6 and an anchorage position in which they are placed at the periphery of this platform so that they can be anchored into the ground.

These bridge elements 3-5 are advantageously connected removably to one another so that the length of each span 1, 2 can be varied. It is thus possible to adapt the length of the bridge to suit the gap (not depicted) that is to be crossed. These bridge elements 3-5 are also articulated to one another.

The first and last bridge elements 3-5 of each span are thus each connected to the intermediate bridge element 4 of this span by a pair of linking arms 7, 8, 9 which is mounted on one and the same lateral edge of these bridge elements 3-5 being positioned between the two spans 1, 2.

One of these linking arms 8 that connects the bridge element 5 intended to constitute the bottom end of the stack formed by the superposed bridge elements 3-5 in the first position of the temporary bridge and the intermediate bridge element 4, also connects this intermediate bridge element 4 to the bridge element 3 positioned at the top end of this stack. This single linking arm 8 therefore connects the three bridge elements 3-5 of the corresponding span 1, 2 and is therefore common to these three consecutive bridge elements 3-5.

These linking arms 7-9 are mounted with the ability to rotate on the bridge elements 3-5 in order to allow the relative movement of each of these bridge elements 3-5. These connecting arms 7-9 for example comprise link rods.

The temporary bridge also comprises movement means for moving each of these bridge elements 3, 4 superposed on another bridge element 4, 5 in said first position, between this first position and a second position, known as the deployed position, in which these bridge elements 3-5 are coupled together longitudinally to form the bridge in its position known as the deployed position.

These movement means here comprise a single actuator 10 essentially positioned between the two spans 1, 2, this actuator therefore being protected by the bridge elements 3-5.

This actuator 10, which for example is a hydraulic jack, is connected with the ability to rotate on the platform 6. In addition, its free end 11 is connected to the linking arm 8 of each of the spans 1, 2 connecting the three respective bridge elements 3-5 thereof via a common pivot pin. A movement of this free end 11 of the jack therefore allows the bridge elements 3-5 of each of the spans 1, 2 to be moved simultaneously. This then ensures uniform and rapid deployment of the bridge.

This common pivot pin in this instance is a reinforcing element such as a girder which at each of its ends connects a corresponding bridge element 4 of each span 1, 2. For preference, this reinforcing element (not depicted) is connected to each of the spans 1, 2 in the region of the axes of rotation of the linking arms with the corresponding bridge elements 3-5, for example in the region of one of the rotary attachments of these linking arms to the bridge elements.

In addition, the use of a single actuator 10 means that the temporary bridge can be made very appreciably lighter, making it easier to transport and to handle. The temporary bridge in its non-deployed position can thus be transported on board a lightweight vehicle unlike the deployable bridges of the prior art which require specially adapted transport equipment.

Moreover, because the linking arms 7-9 and the actuator 10 are positioned between the two spans 1, 2, they are protected from any potential ballistic firings by the structure of the bridge elements 3-5, which forms a shield. Purely by way of illustration, this then, in a military application of this bridge, prevents an enemy projectile from being able to hit the hydraulic circuit of a hydraulic jack or one of the linking arms 7-9, such a hit potentially resulting in the abandonment of the now unusable bridge.

For preference, the temporary bridge comprises a command and control unit (not depicted) to control actuation of the actuator 10 and a self-contained hydraulic fluid supply source for this actuator, this control unit comprising a transmitter-receiver to receive remote control commands.

Because the temporary bridge thus has its own power supply and is autonomous, it may advantageously be positioned near to the gap that is to be crossed so that it can be deployed remotely, thus avoiding exposing a possible team of engineers in areas of conflict.

Figure 3:
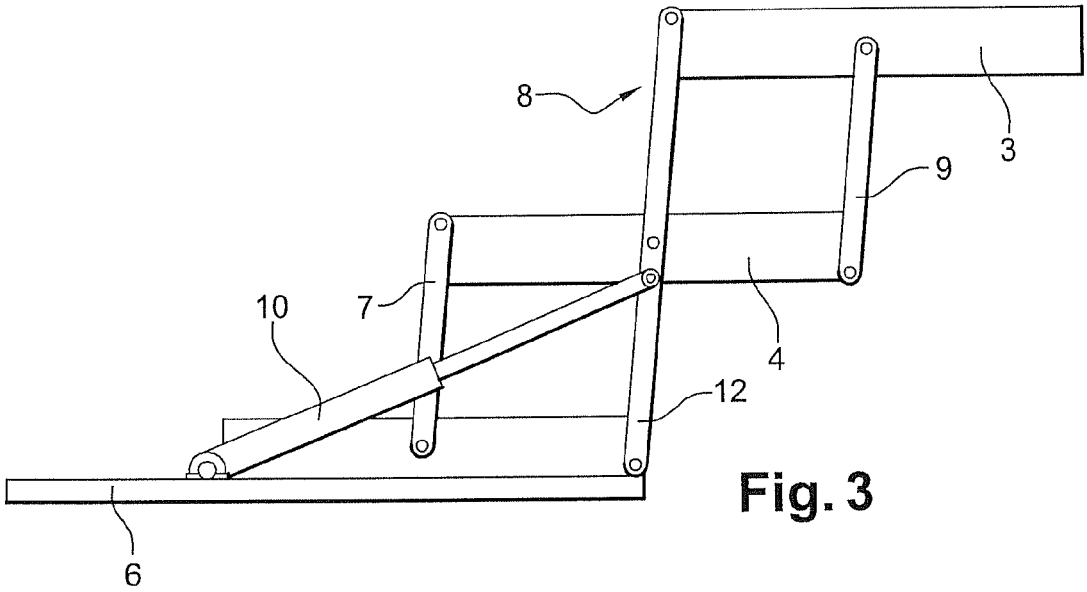
FIG. 3 is a schematic depiction of the temporary bridge of FIG. 1 in which the end of the single actuator has reached the end of its travel, the drive element being in its position of separation.

FIG. 3 shows the temporary bridge in the process of being deployed, the free end 11 of the single actuator 10 having reached the end of its travel. The linking arm 8 connecting the three bridge elements 3-5 of one and the same span 1, 2 is thus forward of a point of equilibrium, i.e. and purely by way of illustration for ground with a flat surface, this linking arm has extended a few degrees beyond a plane that is vertical with respect to the ground and passes through the free end of this actuator, which means that at least the weight of the top bridge element 3 will, under the effect of gravity, complete the deployment of the bridge.

Figure 4:
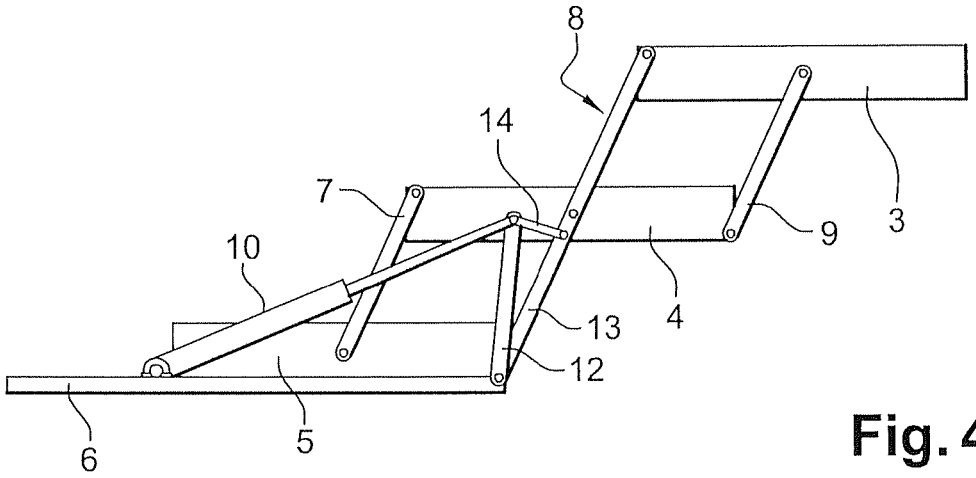
FIG. 4 is a schematic depiction of the temporary bridge of FIG. 1 in which the linking arm is separating from the drive element to allow the end of deployment of said bridge while remaining connected to this drive element by a flexible connection.

These linking arms 8 to which the end 11 of the actuator 10 is connected each preferably comprise a drive element 12 and a corresponding link rod 13 (FIG. 4). The end of the actuator 10 is then directly connected to this drive element 12 which acts as a strut.

This drive element 12 may, for example, be an open tubular portion capable of accommodating and supporting the link rod 13 that connects the three bridge elements 3-5 in order to drive it in its movement brought about by the single actuator 10. This link rod 13 is then connected to the drive element 12 by a flexible connection 14 such as a metal cable, so that the bridge elements 3, 4 continue their movement until the bridge is in the deployed position. During this movement, these upper 3 and intermediate 4 bridge elements are advantageously held by this cable 14 to the jack 10/drive element 12 assembly in order to ensure even and continuous deployment of the temporary bridge.

Figure 5:
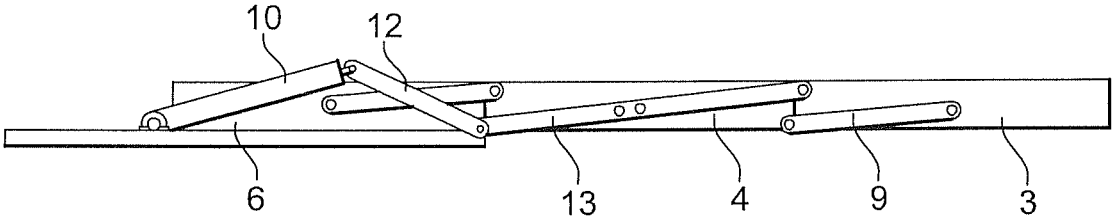
FIG. 5 is a schematic depiction of the temporary bride of FIG. 1, deployed.

Each drive element 12, after the temporary bridge has been deployed, is returned to ground level in order not to impede the progress of vehicles over the surface of the temporary bridge (FIG. 5).

These drive elements 12 may additionally each comprise a winding/unwinding device (not depicted) to accept the corresponding cable 14. Each cable 14 may additionally be connected to the link rod 13 by a removable connection so that once the bridge has been deployed, these cables 14 are returned to their corresponding storage device.

This winding/unwinding device may additionally comprise a winding spindle that is motorized so as to return the temporary bridge from its second position, known as the deployed position, to the position of separation of the link rod 13 from the corresponding drive element 12. In the latter position, the actuator 10 is then activated to retract its moving part comprising the free end 11 of this actuator, and this then returns the bridge elements 3, 4 of each span into the stack that is the first position known as the non-deployed position of the bridge. The drive element 12 makes it possible to ensure that the cable 14 is raised up above the surface of the ground to make it easier to raise the bridge in its deployed position.

Two consecutive linking arms 7-8, 8-9 form, with the at least two consecutive bridge elements 4-5, 3-4 that they connect, a deformable regular parallelogram such that the movement of one bridge element with respect to a bridge element immediately below it in the stack when the temporary bridge is in the non-deployed position causes a circular translational movement of this bridge element with respect to the bridge element immediately below it in the corresponding span 1, 2.

Each bridge element 3-5 may also comprise at least one end stop (not depicted) positioned on its lateral edge accepting the linking arms 7-9 so as to block their movement when the bridge elements 3-5 are placed end to end to form at least part of the deployed bridge.

The temporary bridge comprises an added-on trackway (not depicted) which is a flexible trackway, and fastening elements for securing this flexible trackway to the bridge elements 3-5.

This trackway advantageously has a longitudinal dimension that is greater than the length of the bridge once deployed so as to cover an area of ground adjacent to the deployed bridge.

This trackway is, for example a woven structure which is formed of warp threads laid in a single layer and of weft threads likewise arranged in a single layer, the weave of said woven structure being such that each warp thread is interlaced with the weft threads, preferably and very approximately, along half the intersections of the rows and columns of the weave, the warp thread being left in the remaining intersections so that, for each warp thread, there is obtained at least one region of simple and tightened weave region followed by a region of warp floats, the alternation of the aforementioned various regions leading to bunching of the weft threads creating an embossed structure in the fabric thus produced.

"Preferably and very approximately" means that the takings, or risings, and leavings of each warp thread are not absolutely equal but can on the other hand differ by 10 to 15% for example, or even more, it being understood that the less strictly equal these are, the more adjustments the loom will require.

More generally, this trackway may be a woven structure formed of warp threads arranged in a single layer and of weft threads arranged likewise in a single layer, said woven structure comprising first weft threads positioned over or under second weft threads defining a main plane, said first weft threads thus forming projections in the woven structure.

The weft threads advantageously have a diameter of the order of 50 to 200 hundredths of mm and the warp threads preferably have a diameter smaller than that of the weft threads.

The bridge elements 3-5 therefore comprise girders assembled in parallel with spacing apart from one another. These girders are made of a hard material chosen from the group containing steel, titanium, an aluminum alloy or a composite material. These girders may have a box section or an I-section with a flat surface at each end to support the trackway. These girders may additionally be connected by a bottom skin which may be holed to let water out.

The first and the last of these bridge elements 3, 5 forming the bridge in the deployed position advantageously at their free end comprise an access ramp (not depicted) for accessing this bridge. This access ramp may be mounted in an articulated manner so as to adapt the ramp to suit the equipment or pedestrians that are going to have to travel over the surface of the temporary bridge.

Figure 6:
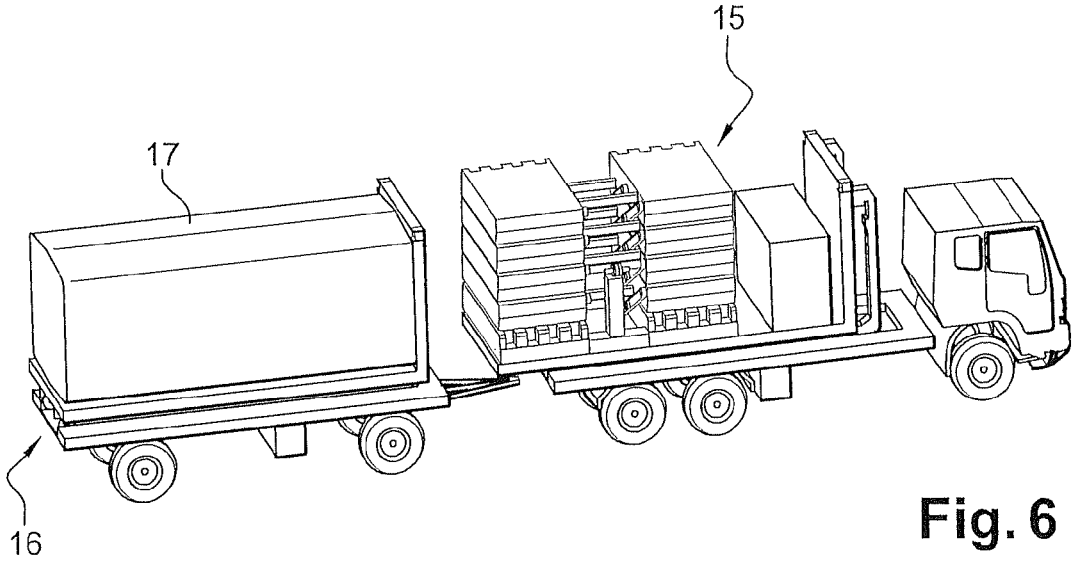
FIG. 6 is a perspective view of a carrier vehicle comprising a container/temporary bridge assembly and towing a trailer containing a container comprising a buoyant structure according to one particular embodiment of the invention.

FIG. 6 is a perspective view of a carrier vehicle comprising a container/temporary bridge assembly 15 and towing a trailer 16 carrying a container 17 containing a buoyant structure according to one particular embodiment of the invention. Each container 15, 17 here is an iso storage container measuring 20 feet (6.058 m) long such that these containers can be transported on conventional utility vehicles, in this instance a logistic transport truck.

Figure 7:
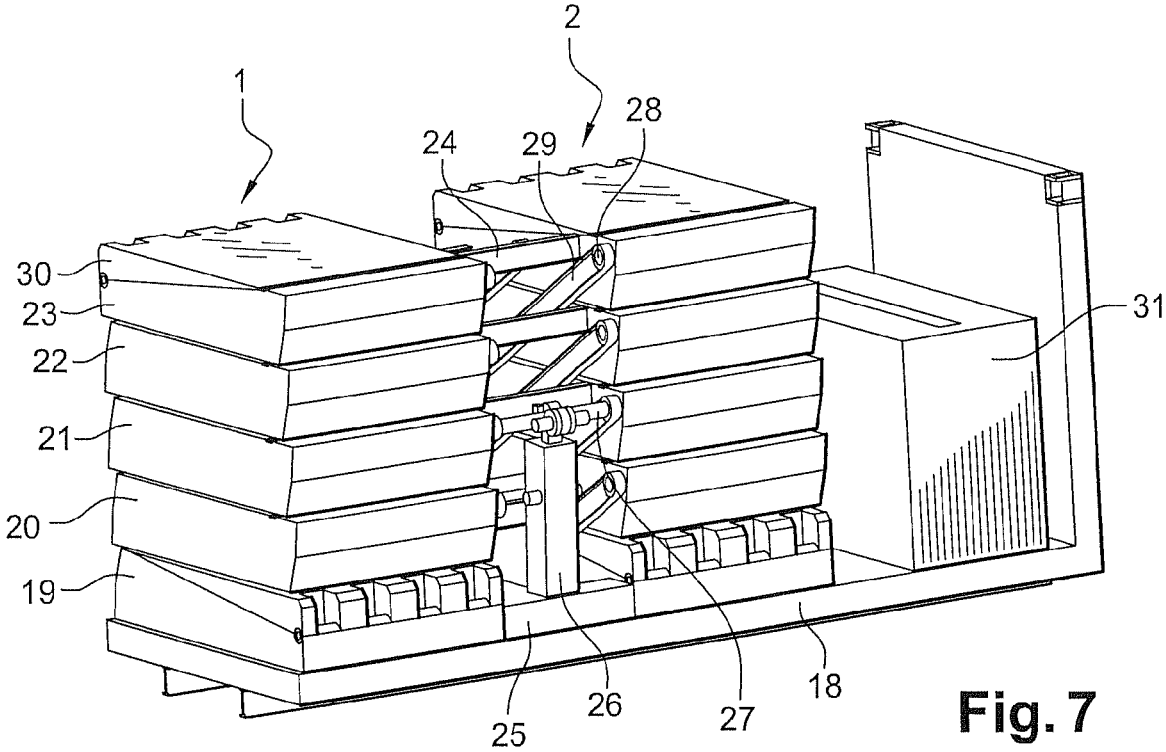
FIG. 7 is a perspective view of the container/temporary bridge assembly of FIG. 6.

FIG. 7 is a detailed view of the container/temporary bridge assembly in its non-deployed position. The container has a bottom 18 on which the temporary bridge is placed in its non-deployed position. Advantageously, the ground clearance of the bottom of the container 15 placed on the carrier vehicle compensates for the difference in relative height between the banks that the temporary bridge is to connect. By way of illustration, this height is of the order of 1 m20 to 1 m60.

The temporary bridge comprises two spans 1, 2 each comprising five bridge elements 19-23. The two spans 1, 2 are joined together by reinforcing elements 24 which in this instance are metal girders. The end bridge elements 19 which are each positioned at the bottom end of the stack of each span 1, 2 when the temporary bridge is in the non-deployed position are joined together by a base 25 supporting the actuator 26. This actuator 26, which is telescopic, is connected removably to a pin 27 connecting the fasteners 28 of the linking arms 29 connected to the bridge elements 20 positioned just above the bottom end bridge elements 19.

Moreover, these end bridge elements 19, 23 each comprise an articulated access ramp 30 which can pivot when the temporary bridge is in its deployed position to form a trackway that is continuous from the surface of the ground.

The bottom 18 of the container 15 comprises an axis of pivoting (not depicted) of the temporary bridge in its non-deployed position so as to allow this bridge to be rotated through 90° so as to position it in a deployment position, also known as the launch position, in which the temporary bridge can be deployed or launched.

For preference, the axis of pivoting is positioned in the container in such a way that, with said temporary bridge in its non-deployed position having been rotated through approximately 90°, said temporary bridge is in a deployment position and is positioned at least partially projecting from the rear end of said container.

For this reason, the container further comprises means for rotating the temporary bridge in its non-deployed position about the axis of pivoting. These means for rotating the bridge are advantageously hydraulic means. Purely by way of illustration, these hydraulic means may comprise an actuator such as a jack, allowing the bridge to be rotated about the axis of pivoting. Alternatively, these hydraulic means may comprise toothed elements positioned at the end of said axis of pivoting, these toothed elements collaborating with complementary meshing elements positioned in said hole in the end bridge element 19 accepting the end of said axis of pivoting so as to impart the rotational movement of the axis of pivoting AP to this bridge element 19.

The container comprises a self-contained hydraulic fluid supply system 31 for supplying hydraulic fluid to the bridge, this system comprising a hydraulic fluid storage unit, a hydraulic pump and a hydraulic feed circuit connected both to the single actuator and to these means for rotating the temporary bridge in its non-deployed position.

Figure 8:
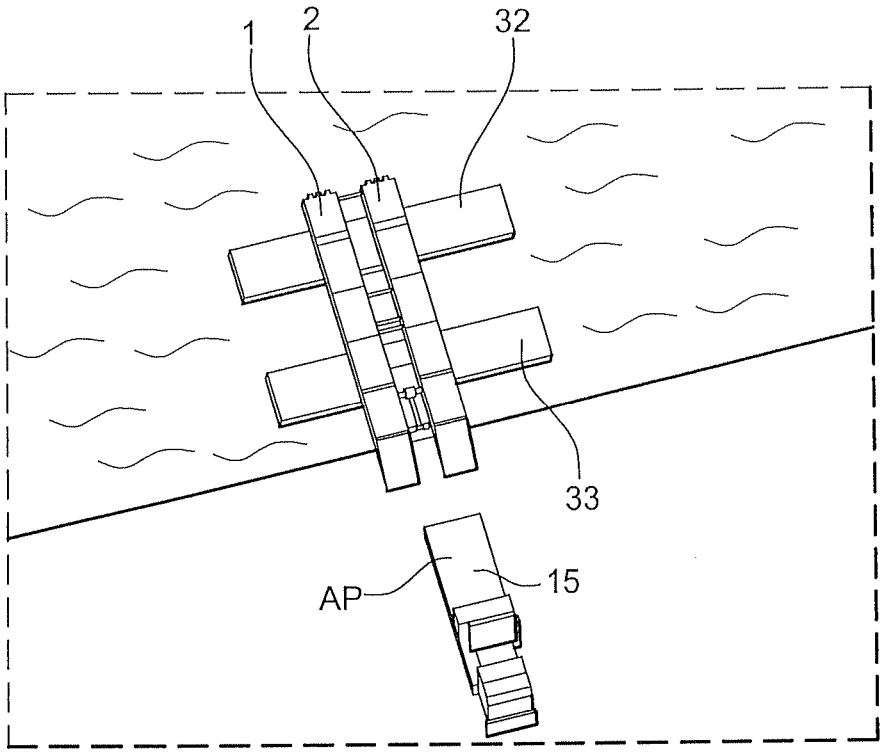
FIG. 8 is a view from above of a temporary bridge in its deployed position, received on and assembled to a buoyant structure according to one embodiment of the invention.
Figure 9:
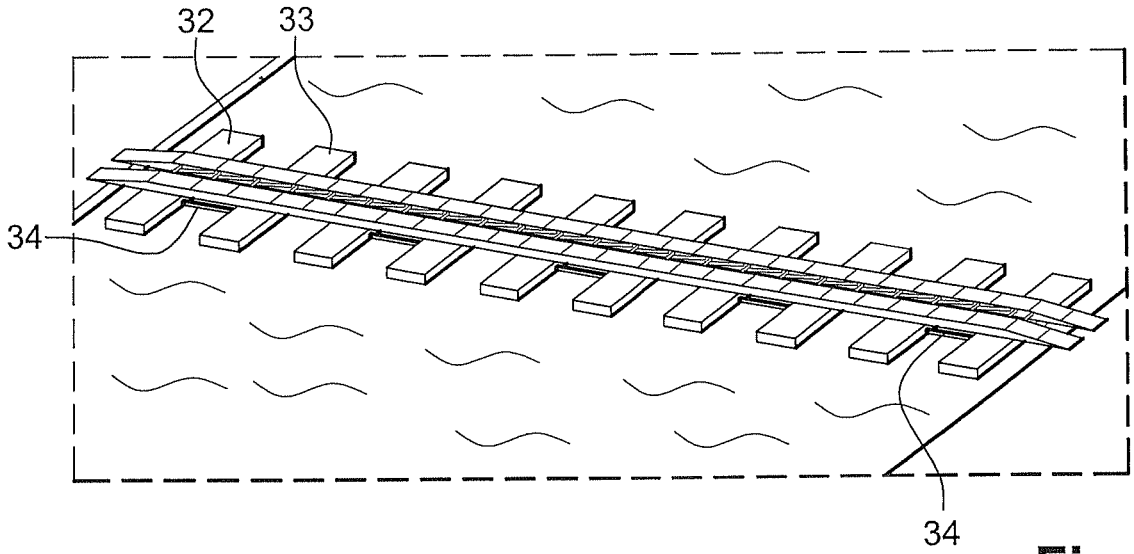
FIG. 9 is a temporary bridge connecting the banks of a river and comprising several temporary bridge/buoyant structure units of FIG. 8 assembled longitudinally to one another according to one particular embodiment of the invention.

FIG. 8 is a view from above of a temporary bridge in its deployed position, received on and assembled with a buoyant structure according to one particular embodiment of the invention.

The buoyant structure is housed in a folded configuration in a separate container 17 supported by the trailer 16 towed by the temporary bridge carrier vehicle.

For preference, this buoyant structure comprises two floats 32, 33 each having a motor allowing them to be maneuvered independently. The floats may additionally comprise means so that they can be controlled remotely from the edge of the wet gap that is to be crossed.

Advantageously, the container 17 containing the buoyant structure is deployed upon launch into the water under gravity. The floats 32, 33 stored in pairs in the container are then released to the surface of the water. They are therefore separated from one another to form a buoyant structure comprising two floats 32, 33 connected to one another by two spacers 34.

The temporary bridge in its deployed position can then be placed on this buoyant structure and secured thereto by fasteners.

Figure 10:
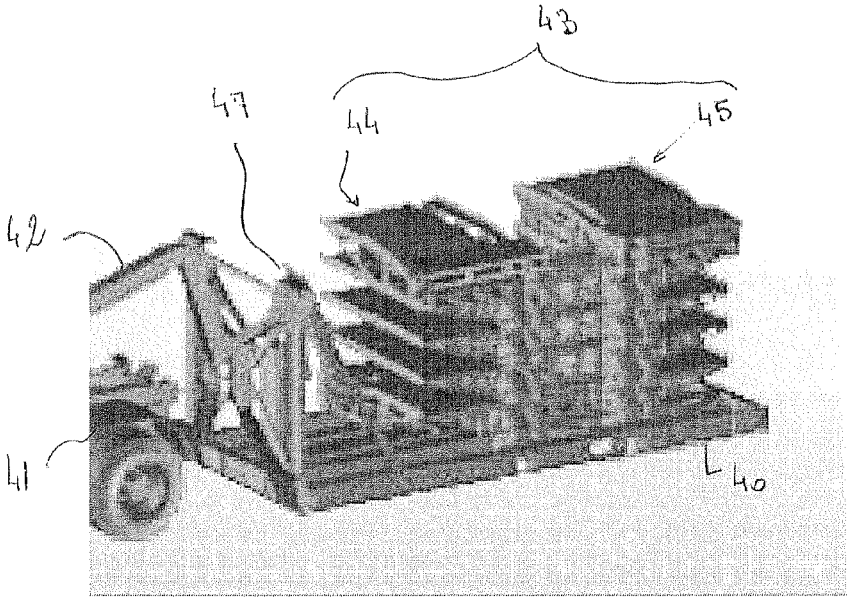
FIG. 10 schematically depicts a partial view of a transporter vehicle and of a container/temporary bridge assembly in its position known as the non-deployed position, according to a preferred embodiment of the invention, said assembly having been set down on the ground by handling means located on said transporter vehicle.
Figure 11:
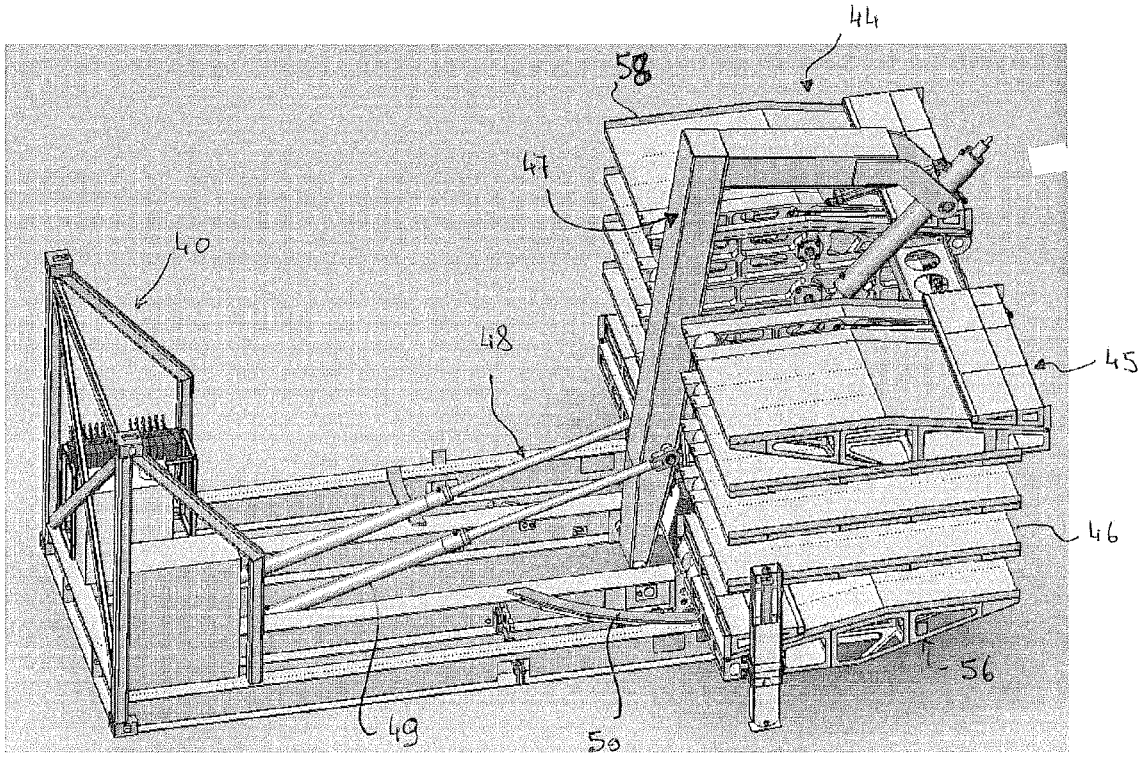
FIG. 11 is a perspective view of said container/temporary bridge assembly of FIG. 10, said temporary bridge in its position known as the non-deployed position, being in a deployment position.

FIG. 10 shows a partial view of a transporter vehicle and of a container/temporary bridge assembly according to one preferred embodiment of the invention.

The container 40 here is an iso storage container measuring 20 feet (6.058 m) long so that it can be transported on utility vehicles such as a logistic transport truck 41.

The container/temporary bridge assembly is placed on the surface of the ground while being connected to handling means 42 positioned on the transporter vehicle 41, these handling means 42 having been used to set down this assembly. These handling means 42 here comprise an articulated handling arm which is connected to a high-pressure hydraulic circuit (not depicted). The transporter vehicle 41 acts as a counterweight during these operations of loading the container/temporary bridge assembly from ground level/setting it down onto the ground.

The temporary bridge 43 is still in its non-deployed position wholly housed inside the container 40. This temporary bridge 43 here comprises two spans 44, 45 each comprising five bridge elements 46 which are superposed when the bridge is in the non-deployed position so as to form, for each span 44, 45, a low-volume vertically stacked structure.

The container 40 also comprises movement means 47 for moving these bridge elements 46 so as to move the temporary bridge between its non-deployed position and its deployed position. These movement means 47 here comprise a single hydraulic actuator connected to a self-contained hydraulic fluid feed circuit, this feed circuit comprising a diesel engine. These movement means 47 are placed on the container with the ability to move between a rest position in which they are retracted to allow the temporary bridge 43 to be positioned in the container 40, and an operational position in which they deploy the temporary bridge 43. The rotational movement of these movement means 47 between these two positions is brought about by jacks 48, 49 which in this instance are hydraulic jacks. For that, the lower part of the movement means 47 is connected by a pivot pin to these girders. The single actuator 47 here comprises a jack capable of applying a pulling force of around 16 metric tons.

The container 40 comprises a perforated floor structure formed of mutually parallel I-girders. Some of these girders define a housing capable at least in part of housing the movement means in their rest position. As the movement means are housed in this housing, the container can accept the temporary bridge in its non-deployed position in a transport position. These girders in this instance are made of steel.

The floor structure of the container also comprises one or more runway tracks 50 guiding the rotation of a supporting turntable 51 that supports the temporary bridge 43 in its non-deployed position. This supporting turntable 51 is itself connected to a slewing ring 52 defining an axis of pivoting AP allowing this turntable to be rotated through at least 90°. Rotating the supporting turntable 51 through 90° allows the temporary bridge 43 to be moved between its position of transport on the transporter vehicle and a deployment position from which it can be launched to cross a gap, this temporary bridge 43 being in its non-deployed position during this movement.

This axis of pivoting AP is formed here by a slewing ring 52 collaborating with said turntable 51, this slewing ring 52 being turned by a rotary double tooth-rack hydraulic jack.

Figure 12:
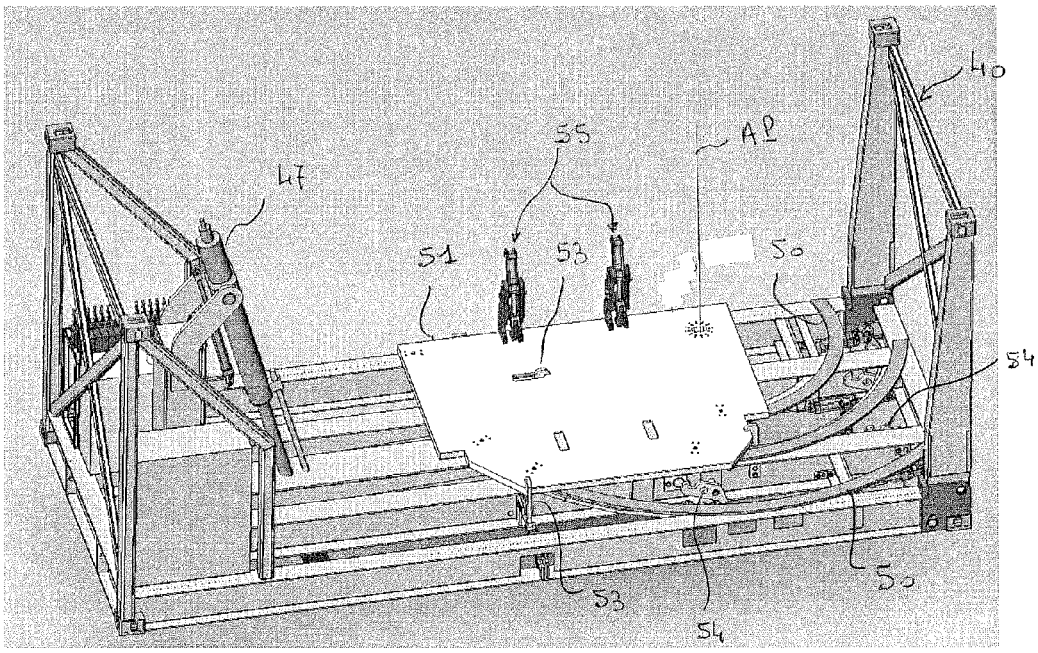
FIG. 12 is a perspective depiction of the container of FIG. 11, the supporting turntable being in the transport position for transporting the temporary bridge in its position known as the non-deployed position.
Figure 13:
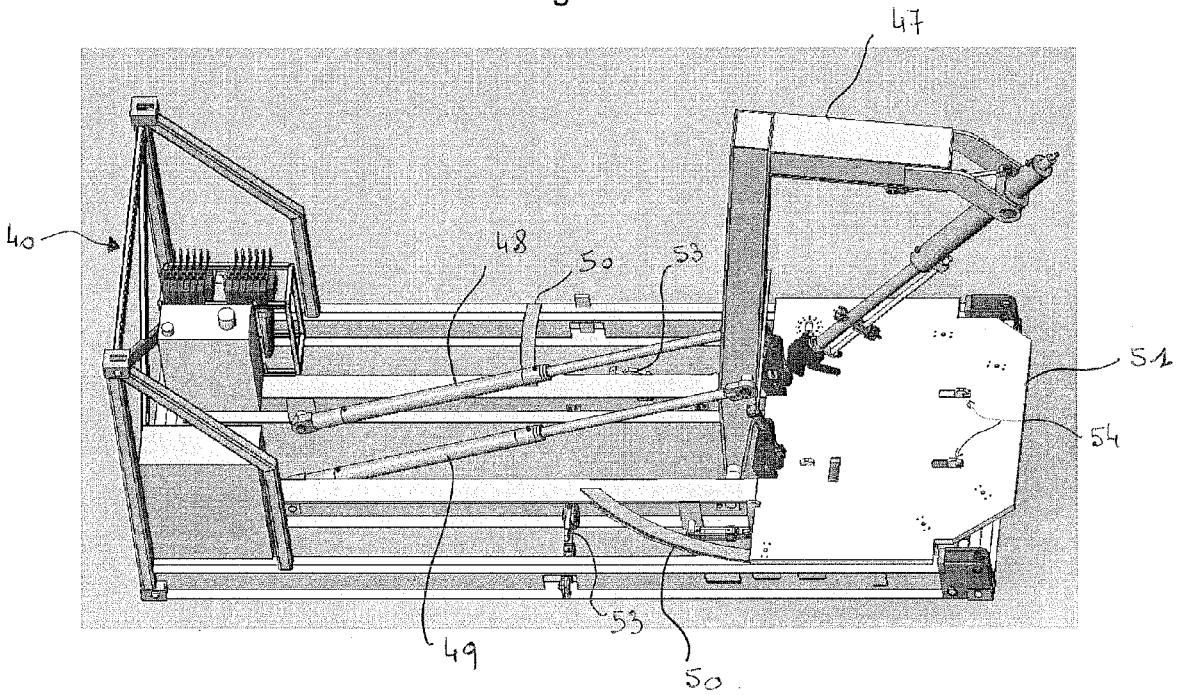
FIG. 13 is a perspective depiction of the container of FIG. 11, the supporting turntable having been rotated through 90° about an axis of pivoting in order to position the supporting turntable in a deployment position in which the temporary bridge can be deployed.
Figure 14:
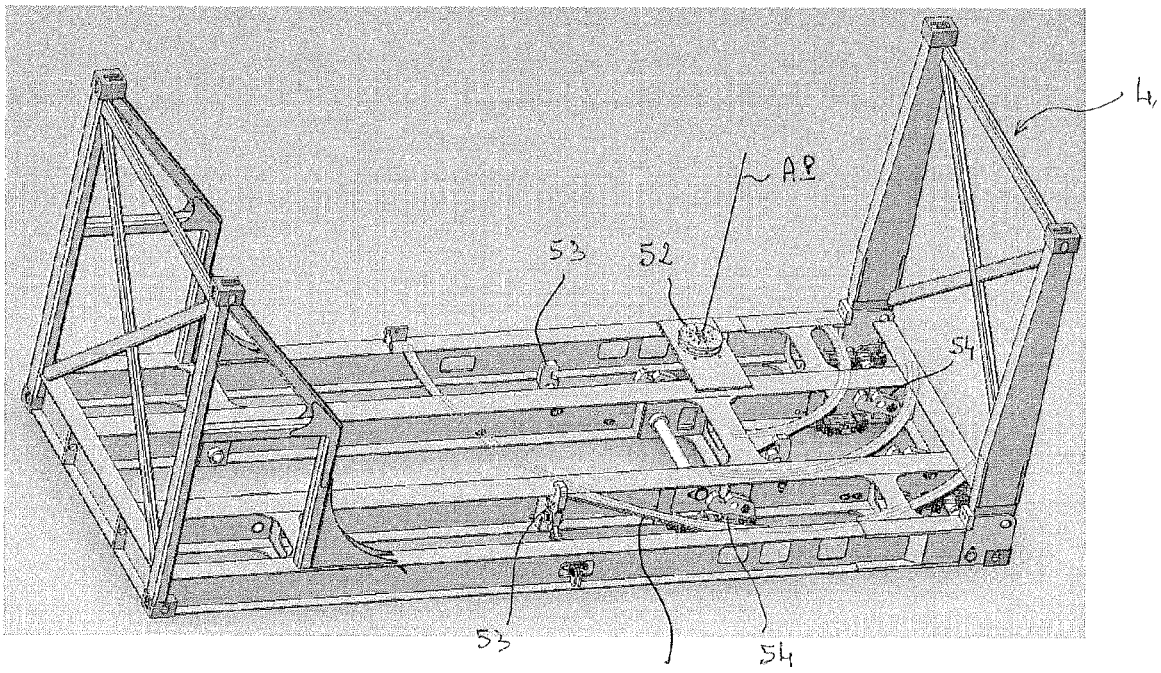
FIG. 14 is a perspective depiction of the container of FIG. 11 without the supporting turntable so as to show the container slewing ring.

The container comprises first fasteners 53 for locking the supporting turntable 51 when the temporary bridge is intended to be placed in the transport position (FIG. 12) and second fasteners 54 for locking the supporting turntable 51 when the temporary bridge is in its deployment position so that the container/turntable assembly reacts the loads associated with the launching of the temporary bridge (FIGS. 13).

These fasteners 53, 54 here are hooks capable of pivoting between an active position and an inactive position in which they are housed in the floor structure of the container 40.

The supporting turntable 51 also comprises third fasteners 55 that allow the bridge elements 56 of the spans 44, 45 intended to form the bottom ends of the stacks to be locked in position when the bridge is in the non-deployed position (FIG. 12).

Figure 15:
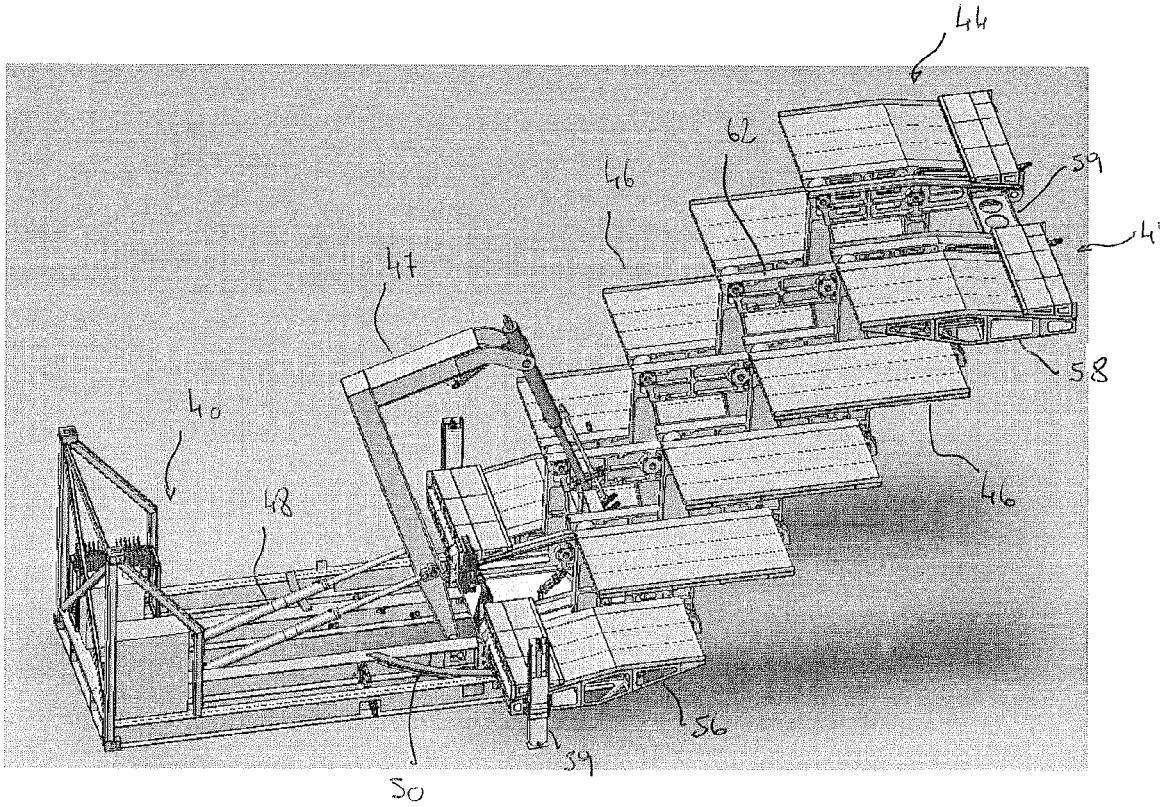
FIG. 15 is a perspective view of the container/temporary bridge assembly of FIG. 11, the temporary bridge being in the process of being deployed.
Figure 16:
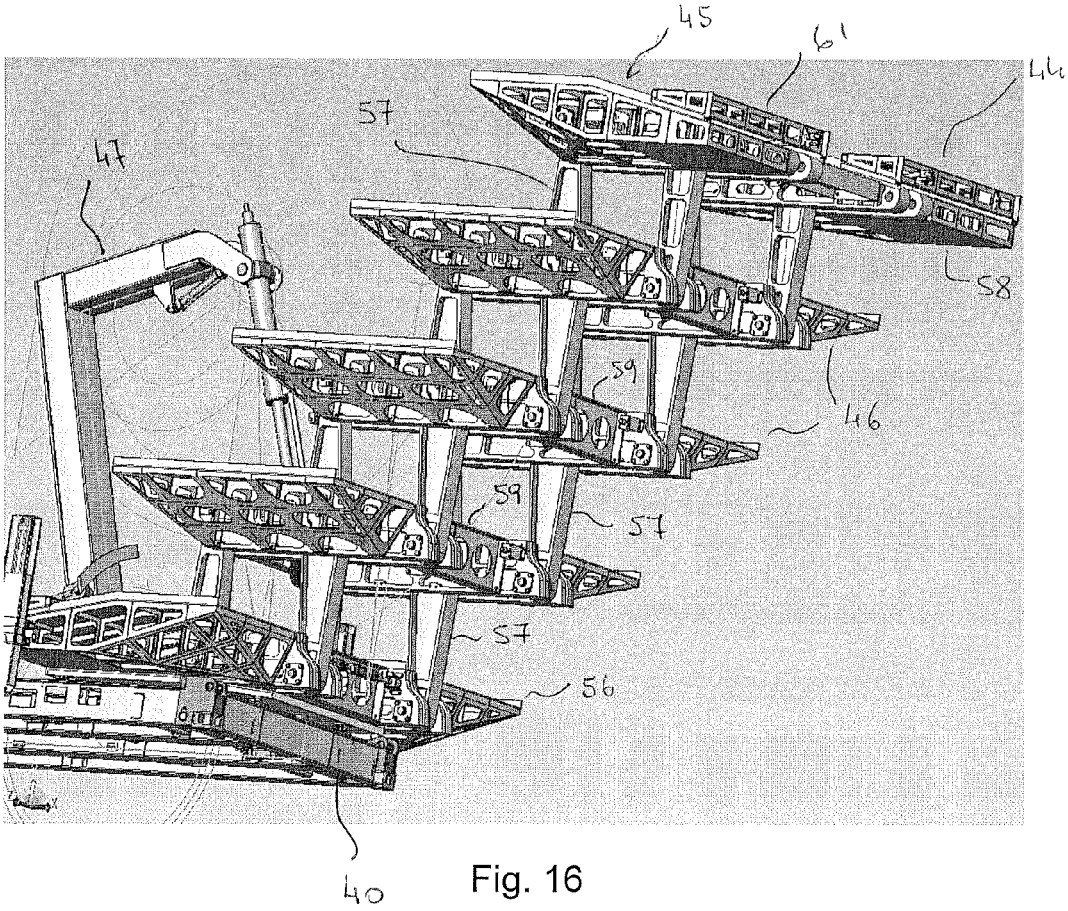
FIG. 16 is an enlarged and partial side view of the container/temporary bridge assembly of FIG. 15.
Figure 17:
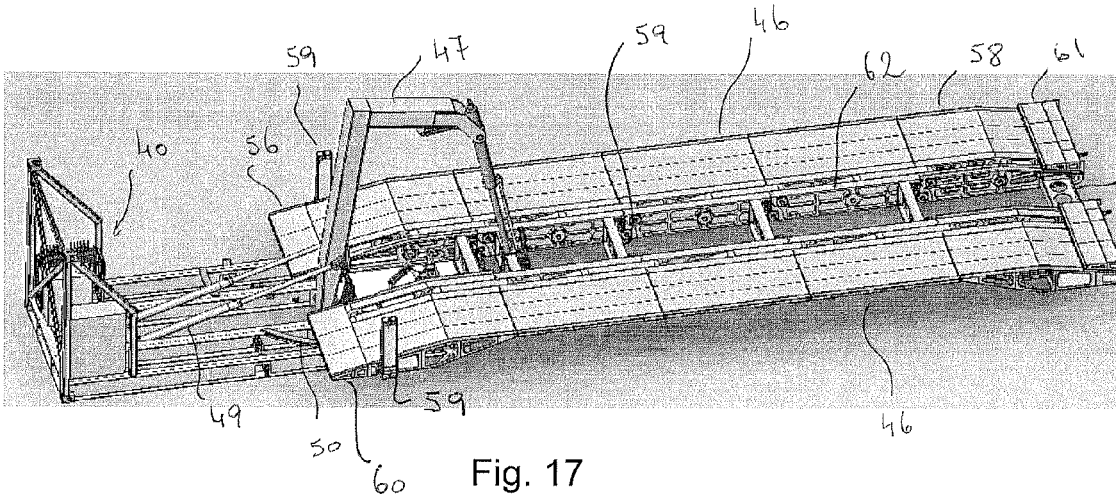
FIG. 17 is a perspective view of the container/temporary bridge assembly of FIG. 11, the temporary bridge being at the end of the deployment phase.
Figure 18:
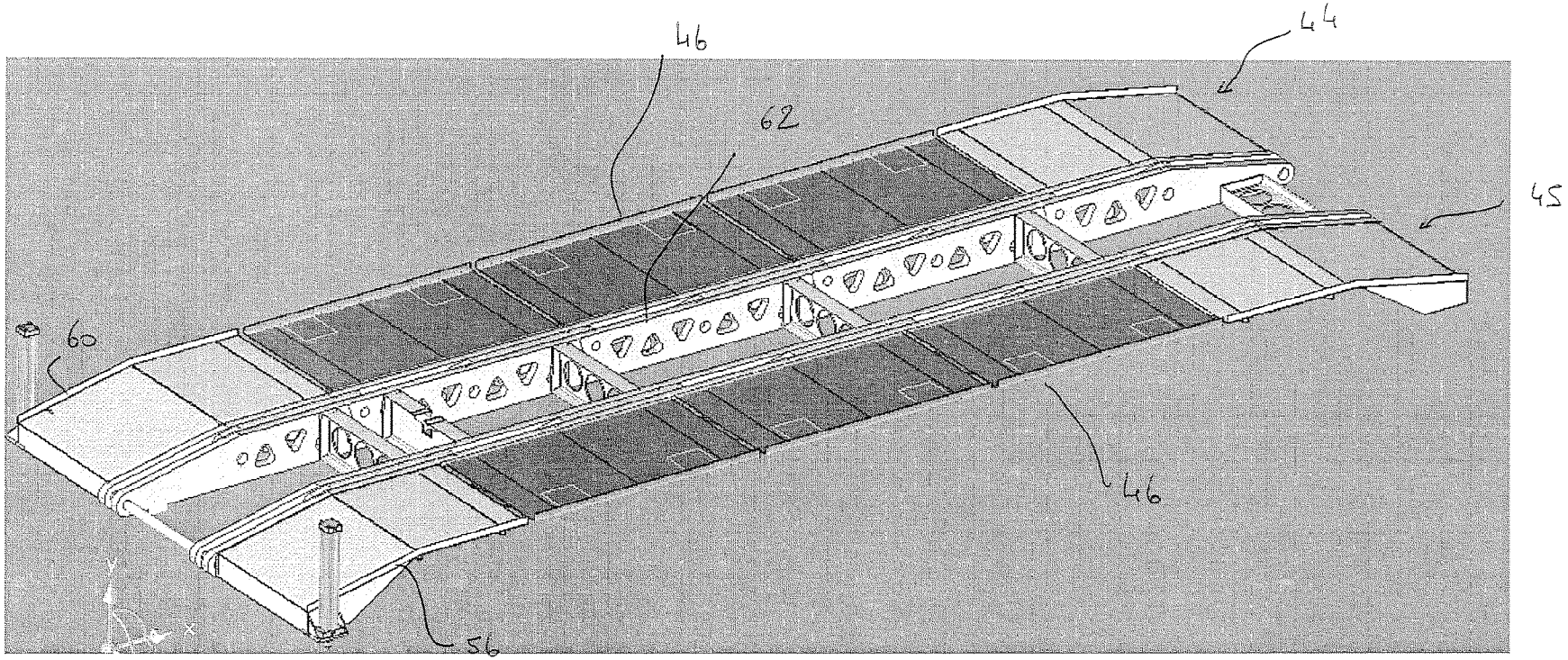
FIG. 18 is a perspective view of the temporary bridge of FIG. 11 with the temporary bridge in its deployed position and separated from the container.

FIGS. 15 and 16 show this container/temporary bridge assembly with the temporary bridge in the process of being deployed. Each span 44, 45 here comprises five bridge elements 46, 56 which are articulated to one another. Two consecutive bridge elements are connected to one another by at least two linking arms 57 mounted on one and the same lateral edge of these bridge elements 46, 56. The bridge elements 46 positioned between the end bridge elements 56, 58 of each of the spans 44, 45 have at least one of their linking arms 57 in common with three consecutive bridge elements, these three consecutive bridge elements then being connected together by this same linking arm 57.

These linking arms 57 here are link rods made of an aluminum alloy chosen for its mechanical properties and lightness of weight. The components are carefully engineered to have material in the regions of highest stress. When the temporary bridge is in its deployed position, these link rods 57 lock together by a keying system (not depicted) so as to react the torsional loadings applied by vehicles traveling across the surface of this bridge, and bolts (not depicted) lock the kinematics of the link rods 57 on each bridge element 46, 56, 58 so as to stiffen the bridge as a whole.

Moreover, the temporary bridge comprises reinforcing elements 59 connecting the corresponding bridge elements 46, 56, 58 of the two spans 44, 45 together. These reinforcing elements 59 are spacer pieces one meter long made in aluminum, except for one of these spacer pieces which is made in steel. The latter is also used as a point of attachment for the deployment jack, or actuator, 47 that deploys the temporary bridge so as to allow the bridge elements 46, 56, 58 of each of the spans 44, 45 to move simultaneously. This ensures uniform and rapid deployment of the bridge.

The trackways for the vehicles are mechanically welded assemblies in high-strength aluminum so as to lighten the weight of the temporary bridge. In order to reduce the span of the trackways, the vehicles also run along the girders formed by the link rods when the temporary bridge is in its deployed position.

Reinforcing latticework structures 62 are positioned on the inside of the temporary bridge and connected to the corresponding spans 44, 45. The linking arms 57 are thus positioned between the bridge elements 46, 56, 58 and these latticework structures 62. The latter enhance the mechanical integrity of the temporary bridge so that it is able to withstand the mechanical stresses (sheer stress, windage, etc.) applied to it.

Once the bridge is in its deployed position, the hooks 55 of the supporting turntable 51 release the temporary bridge, the container is moved forward, and the legs 59 of the bridge are retracted so that the end bridge elements rest on the ground. During this phase, the temporary bridge remains hydraulically and electrically supplied by winders, which are disconnected from the bridge once it is set down on the ground.

The single actuator 47 is retracted into the floor structure of the container 40 in transport mode, and in its bottom part comprises part of the runway track for the rolling runners of the turntable. In its upper part, a small jack orients the main jack, this small orientation jack being set free (hydraulically short circuited) when the main jack is connected to the temporary bridge reinforcing element 59 with a view to maneuvering it. It is the translational movement of the free end of the main jack that causes the link rods to turn and the bridge to rotate, the deployment or retraction of the bridge being dependent on the position of the single actuator 47 passing the point of equilibrium at mid-deployment.

When the bridge is being retracted, the reverse operations to deployment are performed, but in order to position the container under the temporary bridge by backing up the transporter vehicle, this container 40 is also equipped with wheels which deploy hydraulically from housings provided for that purpose in the container (and which have not been depicted).

The access ramps 60 of the bridge are deployed by hand, and the exit ramps 60 are deployed either by hand or via a mechanical linkage system at the same time as the temporary bridge is being deployed.

All the pivot connections are afforded by the rubbing of tough steel pivot pins against permaglide (composite/metal) bushings with the exception of the yokes of the jacks and of the supporting turntable 51 which uses a slewing ring at the axis of rotation and rolling runners. The pivot pins of the various pivots of the container are solid tough steel, and the pivot pins for the bridge link rods are made of hollow tough steel.

Purely by way of illustration, the present temporary bridge is a bridge measuring 11 meters long with an MLC 40 load rating. This temporary bridge, which offers a trackway width of 4 meters, weighs 6500 kg. It is able to span gaps of up to 10 meters and takes just one vehicle at a time across its surface. It can be set down on the ground and deployed by just two operators in a time of 15 minutes or less.

The invention claimed is:

1. A temporary bridge comprising:

two spans, in a non-deployed position, each of the two spans is separate and spaced apart from the other span, each of the two spans comprising at least first, second, and third bridge elements articulated to one another, said second bridge element being consecutive with said first bridge element and located below the first bridge element, said third bridge element being consecutive with the second bridge element and located below the second bridge element, each of said bridge elements having a first lateral edge and an opposite second lateral edge, wherein, when in the non-deployed position, said bridge elements are vertically superposed one located on top of another, two linking arms located on the first lateral edge of said first and second bridge elements and joining together said first and second bridge elements, wherein, the first and second bridge elements joined by the two linking arms form a deformable regular parallelogram such that movement of the first bridge element with respect to the second bridge element immediately below from said non-deployed position is a circular translational movement of said first bridge element with respect to said second bridge element wherein, a first of said two linking arms is common to each of said first, second, and third bridge elements, said first, second, and third bridge elements being connected to one another by said first linking arm, and a movement element that moves each of said first, second, and third bridge elements from said non-deployed position, in which said first, second, and third bridge elements are vertically superposed one located on top of another, to a deployed position with each of said first, second, and third bridge elements being linearly coupled together in a straight line to form said bridge.

2. The bridge as claimed in claim 1, wherein, in said deployed position, said first bridge element of a first one of said two spans is connected to a corresponding first bridge element of a second one of said two spans.

3. The bridge as claimed in claim 2, wherein, in said deployed position, a further linking arm connects the third bridge element of a first of said two spans with a corresponding third bridge element of a second of said two spans.

4. The bridge as claimed in claim 2, further comprising one or more reinforcing elements connecting said spans together.

5. The bridge as claimed in claim 1, wherein said movement element comprises a single actuator with a moving end connected to said two spans so as to move the bridge elements of the two spans simultaneously.

6. The bridge as claimed in claim 5, wherein the moving end of said actuator is connected to a reinforcing element connecting said two spans together.

7. The bridge as claimed in claim 6, wherein, the moving end of said actuator is connected to the second linking arm of each of said two spans, each of said second linking arms comprises a link rod connecting three consecutive bridge elements together and an element for driving said link rod to a free end of said actuator, said link rod is connected to said drive element by a flexible connection so that said actuator is able to move an assembly comprising said link rod and said drive element from a rest position into a position of separation of said link rod in which position said link rod separates from said drive element to continue movement while at the same time remaining connected to said drive element by said flexible connection.

8. The bridge as claimed in claim 7, wherein said drive element comprises a winding-unwinding device that accepts said flexible connection.

9. The bridge as claimed in claim 1, further comprising:

for each span, a bridge element constituting a bottom end of a stack formed by the superposed bridge elements when in the non-deployed position, said bridge element having the movement element mounted thereto, the movement element comprising at least one jack for raising or lowering the bridge elements from the non-deployed position to the deployed position with respect to a surface of ground surrounding each of said bridge elements.

10. The bridge as claimed in claim 1, further comprising at least one buoyant structure on which said temporary bridge is intended to be placed when said temporary bridge is launched onto water.

11. The bridge as claimed in claim 1 in combination with a container that holds said bridge in the non-deployed position.

12. The combination as claimed in claim 11, wherein said container is a storage container measuring 20 feet (6.058 m).

13. The combination as claimed in claim 11, wherein said container comprises a floor structure comprising a housing that at least partially accepts said movement element such that said movement element can at least partially move aside to allow said temporary bridge in the non-deployed position to be positioned in said container in a transport position.

14. The combination as claimed in claim 11, wherein a bottom of said container comprises an axis of pivoting of said temporary bridge in the non-deployed position so as to allow said temporary bridge to be rotated with respect to said bottom in order to place said temporary bridge in a deployment position.

15. The combination as claimed in claim 14, wherein said container also comprises means for rotating said temporary bridge in the non-deployed position about said axis of pivoting (AP).

16. The combination as claimed in claim 15, wherein said container comprises a supporting turntable, said turntable being turned by a rotary tooth-rack jack, said turntable being able to accept the temporary bridge in the non-deployed position.

17. The combination as claimed in claim 14, wherein said axis of pivoting is positioned in said container in such a way that, with said temporary bridge in the non-deployed position having been rotated through approximately 90°, said temporary bridge is in the deployment position and is positioned at least partially projecting from a rear end of said container.

18. The combination as claimed in claim 11, wherein said container is a storage container measuring 20 feet (6.058 m) long.

19. The bridge as claimed in claim 1, wherein, reinforcing elements join the two spans together in a spaced apart relationship, the movement element is connected to both of said two spans, and the movement element simultaneously moves each of said first, second, and third bridge elements from said non-deployed position to the deployed position linearly coupled together in the deployed position so that said bridge elements of each of said two spans are connectedly arranged in a parallel manner to each other.

20. A temporary bridge, comprising:

two spans, in a non-deployed position, each of the two spans is separate from the other span, each of the two spans comprising i) at least first, second, and third bridge elements articulated to one another, said second bridge element being consecutive with said first bridge element and located below the first element, said third bridge element being consecutive with the second bridge element and located below the second bridge element, each of said bridge elements having a first lateral edge and an opposite second lateral edge, wherein, when in the non-deployed position, said bridge elements are vertically superposed one located on top of another, and ii) two linking arms located on the first lateral edge of said first and second bridge elements and joining together said first and second bridge elements, wherein, the first and second bridge elements joined by the two linking arms form a deformable regular parallelogram such that movement of the first bridge element with respect to the second bridge element immediately below from said non-deployed position is a circular translational movement of said first bridge element with respect to said second bridge element wherein, a first of said two linking arms is common to each of said first, second, and third bridge elements, said first, second, and third bridge elements being connected to one another by said first linking arm; and a movement element connected to both of said two spans, wherein the movement element simultaneously moves each of said first, second, and third bridge elements from said non-deployed position, in which said first, second, and third bridge elements are vertically superposed one located on top of another, to a deployed position with each of said first, second, and third bridge elements being linearly coupled together in a straight line to form said bridge, in said deployed position, said bridge elements of each of said two spans are connectedly arranged in a parallel manner to each other.

* * * * *